United States Patent [19]

Miller

[11] 4,252,394

[45] Feb. 24, 1981

[54] HERMETIC COMPRESSOR MOTOR TERMINAL

[75] Inventor: Austin S. Miller, Tecumseh, Mich.

[73] Assignee: Tecumseh Products Company, Tecumseh, Mich.

[21] Appl. No.: 39,669

[22] Filed: May 16, 1979

[51] Int. Cl.[3] ..... H01R 13/02

[52] U.S. Cl. ..... 339/94 A; 174/152 GM; 310/68 C; 337/181; 339/192 R; 361/24

[58] Field of Search ..... 339/94, 147, 192; 174/50.61, 152 GM; 361/24; 310/68 C; 337/181

[56] References Cited

U.S. PATENT DOCUMENTS

| | | | |
|---|---|---|---|
| 945,995 | 1/1910 | Weeks | 339/192 R |
| 2,825,856 | 3/1958 | Gates | 174/152 GM |
| 3,370,878 | 11/1968 | Dozier | 339/192 RL |
| 3,371,413 | 3/1968 | Rundle | 174/152 GM |
| 3,586,910 | 6/1971 | Sauber | 339/147 R |

FOREIGN PATENT DOCUMENTS

| | | | |
|---|---|---|---|
| 570539 | 7/1945 | United Kingdom | 174/152 GM |

*Primary Examiner*—Joseph H. McGlynn
*Attorney, Agent, or Firm*—Albert L. Jeffers; John F. Hoffman

[57] ABSTRACT

A hermetic electrical terminal construction adapted for connection to the outer housing of a hermetic motor compressor unit so that current may be carried to the compressor motor from an external source. The terminal comprises a body member welded or otherwise secured to the compressor outer housing and a plurality of conductor pins secured to and extending through the body member. Each of the conductor pins, which may be made of stainless steel, copper or other suitable material, comprises a first segment disposed within the housing, a second segment disposed outside the housing, and an intermediate segment connecting the first and second segments, the intermediate segment being disposed primarily within the body member. Electrical insulating and sealing material, such as glass or epoxy potting, surrounds the pin intermediate segment and forms a hermetic seal between the pin intermediate segment and the body member. The intermediate segment has a larger transverse cross-sectional area than the segment disposed outside the compressor housing with a concomitant larger current carrying capacity so that under irreversible overcurrent conditions, the normal diameter external segment will melt thereby interrupting the supply of current. Since the intermediate portion is of a greater current carrying capacity, it will remain intact and the seal between the potting material and pin will not be disturbed so that the pressurized refrigerant within the compressor housing will not be discharged.

10 Claims, 6 Drawing Figures

HERMETIC COMPRESSOR MOTOR TERMINAL

BACKGROUND OF THE INVENTION

The present invention relates to a hermetic compressor motor terminal, and in particular to such a terminal which will maintain the integrity of the seal between it and the compressor housing even under high overcurrent conditions.

Terminal assemblies for hermetic compressors are well known and generally comprise a cup-shaped metallic body member having a plurality of metallic conductor pins extending therethrough. In order to seal and electrically insulate the conductor pins relative to the body member, they are usually either potted in epoxy or sealed in glass. Both the inner and outer ends of the conductive pins may be provided with conductor tabs so as to facilitate connection to the external current source and to the compressor motor. Examples of such motor compressor terminals are disclosed in U.S. Pat. Nos. 4,059,325, 3,770,878, and 3,988,053.

One of the persistent problems with prior art electrical terminals for hermetic compressors is that when abnormally high overcurrent conditions exist, such as a ground fault or short circuit, the conductor pins melt, which allows the hot, high pressure gas and liquid from the compressor to discharge through the opening in the terminal assembly left by the melted conductor pin. Obviously, this is an extremely hazardous situation for persons in the vicinity of the compressor, because the gas and liquid will be ejected at high pressure.

Although attempts have been made to prevent shorting of the conductor pins by shielding them from contaminants produced during motor failure, this still does not solve the problem of preventing destruction of the seal in the event that overcurrent conditions are sufficiently large to cause melting of one or more of the conductor pins. The purpose of the present invention is to insure that the seal remains intact even during irreversible overcurrent conditions of sufficient magnitude to melt the normal diameter pins.

SUMMARY OF THE INVENTION

The above-discussed problem is solved by the present invention wherein the conductor pins are formed with an oversized diameter portion within the sealing and insulating material so that the normal diameter portion extending externally of the compressor housing will melt first thereby terminating the supply of current and permitting the large diameter portion to remain intact so that the integrity of the seal is not distrubed. Furthermore, the material of the terminal pin is selected to have a lower melting temperature than the melting or degrading temperature of the insulating and sealing material surrounding it.

Specifically, the present invention contemplates a terminal construction for a hermetic motor compressor having an outer housing with an opening therein. The terminal comprises a body member covering the housing opening and having at least one opening therein communicating externally with the interior of the housing. A metallic conductor pin is disposed in the last-mentioned opening and passes through the body member so that current may be carried from an external current source to the compressor motor. The conductor pin comprises a first segment disposed within the housing, a second segment disposed outside the housing, and an intermediate segment connecting the first and second segments, wherein the current carrying capacity of the intermediate segment is greater than that of the segment extending externally of the housing. Electrical insulating and sealing material surrounds the pin intermediate segment and forms a hermetic seal between the pin intermediate segment and the body member. The transverse cross sectional area of the second segment is such that the current carrying capacity thereof is capable of meeting the requirements of the compressor motor, and the transverse cross sectional area of the intermediate segment is such that the current carrying capacity thereof is sufficiently great that it will not melt under irreversible overcurrent conditions, which conditions would cause the second, external segment to melt. The electrical insulating and sealing material has a higher melting temperature than the conductor pin intermediate segment and second segment so that the overcurrent conditions will cause the second segment to melt first, thereby interrupting the supply of current to the compressor motor.

DETAILED DESCRIPTION

Figure 1:
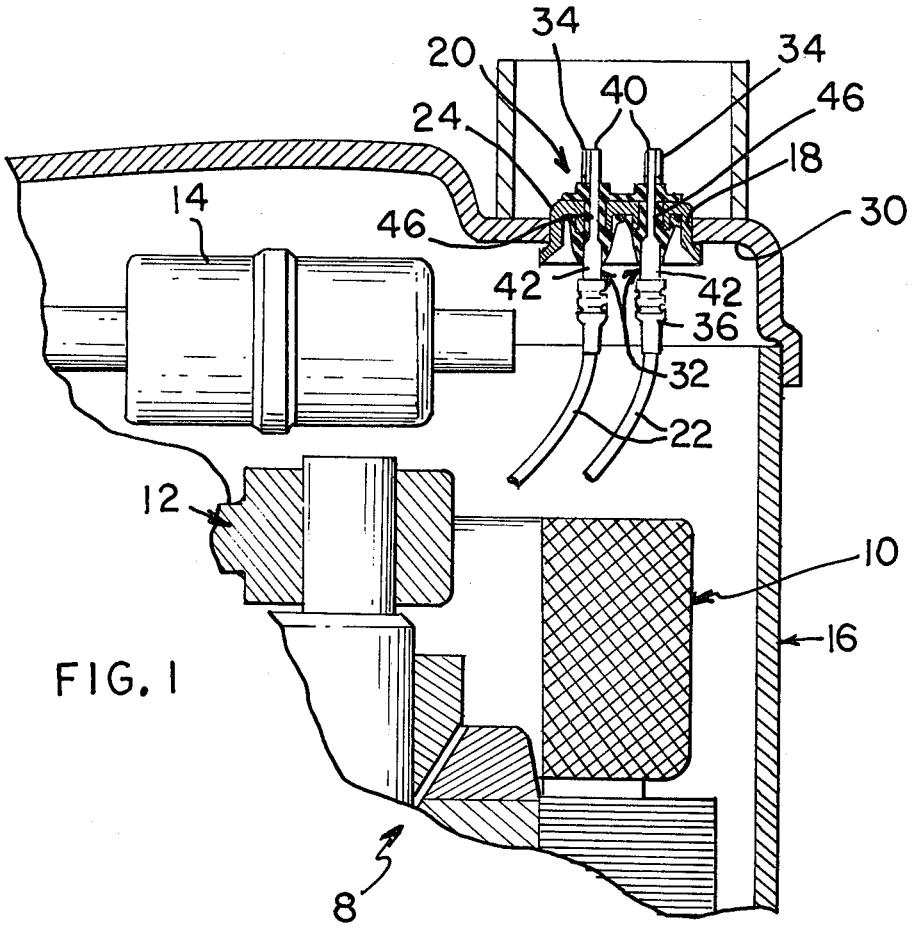
FIG. 1 is a cut away, partially sectioned view of a hermetic motor compressor provided with the motor terminal according to the present invention.
Figure 2:
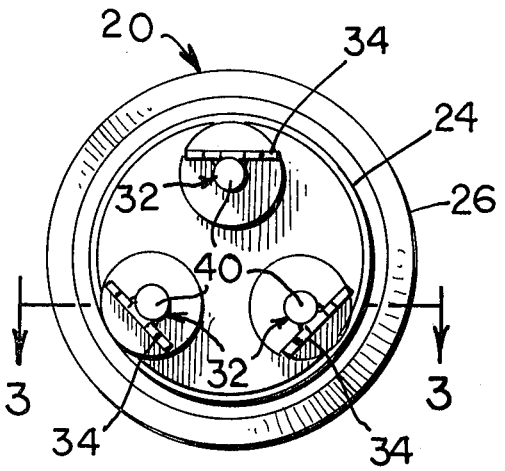
FIG. 2 is a plan view of the terminals.
Figure 5:
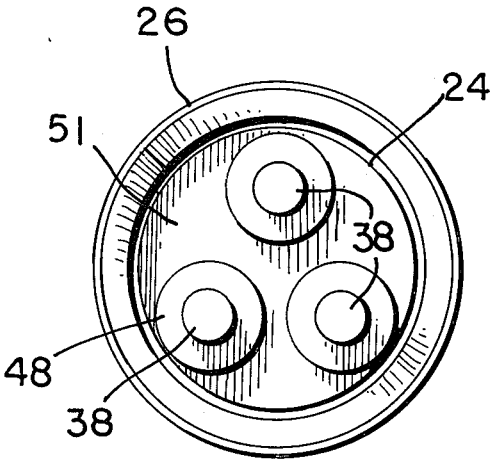
FIG. 5 is a bottom view of the terminal.
Figure 3:
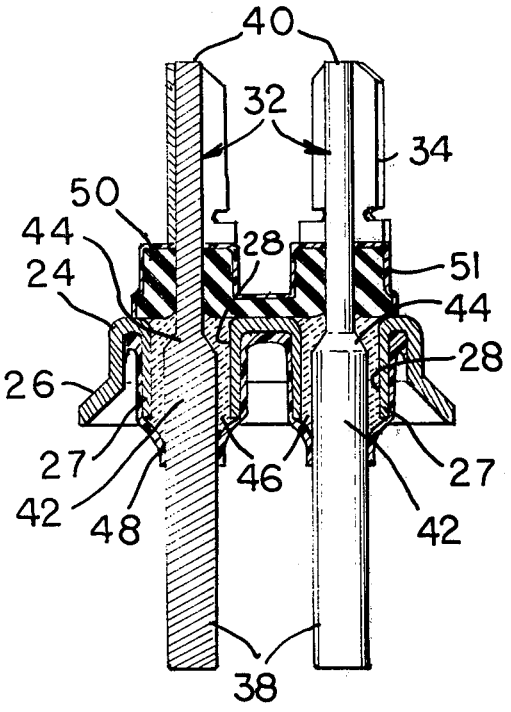
FIG. 3 is a sectional view taken along line 3—3 of FIG. 2 and viewed in the direction of the arrows.
Figure 4:
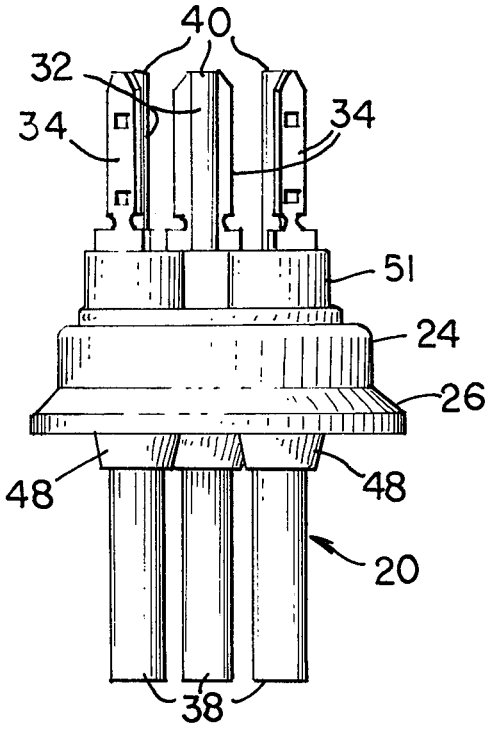
FIG. 4 is an elevational view of the terminal.
Figure 6:
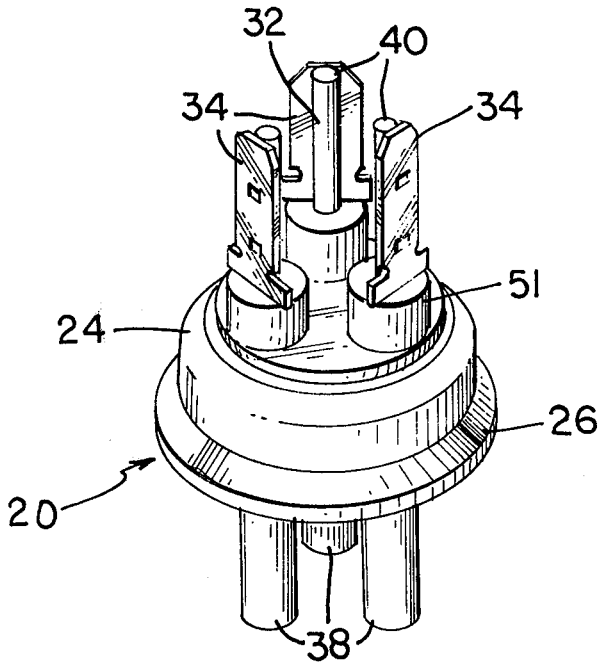
FIG. 6 is a perspective view of the terminal.

Referring now to the drawings, FIG. 1 illustrates a typical hermetic motor compressor unit 8 comprising an electric motor 10 and piston-type compressor, the connecting arm assembly 12 thereof being shown, and discharge muffler 14. The compressor and motor 10 are hermetically sealed within a metallic housing 16 having an opening 18 therein within which motor terminal 20 is secured. Terminal 20 conducts current from external leads (not shown) to motor 10 over leads 22 and, as will be described in greater detail below, is designed such that the motor compressor unit remains hermetically sealed even under irreversible overcurrent conditions of a catastrophic nature.

Terminal 20 comprises a metallic, cup-shaped body member 24 having a flange 26 and three inwardly extending collars 27 defining openings 28 extending through body member 24. Flange 26 is disposed against the inner surface 30 of housing 16 when terminal 20 is welded in place thereby ensuring that the body member 24 will not be dislodged by the high pressure within housing 16.

Received in each of the collars 27 is a metallic conductor pin 32 made of a suitable conducting material, such as stainless steel, copper, or copper core stainless steel. Pins 32 are preferably of integral construction and are provided with tabs 34 secured to their external ends in order to facilitate the attachment of connecting leads (not shown). If desired, the internal ends of conductors 32 may also be provided with suitable tabs or connectors 36 for ease in attaching leads 22.

Each of the conductor pins 32 comprises a first segment 38 disposed within compressor housing 16, a second segment 40 disposed externally of housing 16, and an intermediate segment 42 integral with segments 38 and 40 and disposed primarily within body member 24. Intermediate portion 42 includes a shoulder 44 which tapers inwardly from the larger diameter intermediate segment 42 to the smaller diameter external segment 40. Alternatively, shoulder 44 may be at right angles to segments 42 and 40, in which case the transition from the larger diameter to the smaller diameter would occur abruptly, without any taper.

In order to electrically insulate the conductor pins 32 relative to body member 24 and to seal the space between pins 32 and the inner surfaces 28 of collars 27, this space is filled with glass 46, which is compression fused therein. Alternatively, an epoxy potting compound could be used in place of glass 46. Collars 27, the internally exposed portions of glass 46, and portions of conductor pins 32 are coated with an epoxy coating 48, which serves to protect the otherwise exposed surfaces from corrosion and acid attack. Alternatively, conductor pins 32 could be potted by a single integral mass of epoxy, such as a glass filled epoxy molding compound. In any event, the material which is used to seal and insulate pins 32 with respect to body member 24 must be in intimate contact with the respective surfaces of pins 32 and member 24. A silicon rubber cap 50 is disposed over pins 32 and on top of body member 24, and the external surfaces are coated with a suitable epoxy 51. Regardless of the particular construction and material for the seal, it is necessary that it have a higher melting temperature than that of pins 32 so that the external segments 40 of the pins will melt before the sealing material 46.

It should be noted that the particular structure for the seating material, whether it be of glass-epoxy construction or of epoxy alone, is not the subject of the present invention, which is directed to the current carrying capacity of the various segments of pins 32 and the relationship between the melting temperatures of the sealing and insulating material and the pins 32.

The diameter of the external segment 40 for each pin 32 is selected such that its current carrying capacity will equal the amperage rating for the electrical circuit including compressor motor 10. For example, if the supply circuit for motor 10 is to have a 100 amp. rating, then the diameter of segment 40 should be sufficient to carry this amount of current under conditions of normal use. Such relationships between conductor current carrying capacity and the current ratings for electric motor circuits are well known and will not be discussed in detail.

Since it is desirable to terminate the supply of current if irreversible overcurrent conditions occur due to a failure of the motor pin or another type of short circuit or ground fault, the diameter of external segment 40 for each pin 32 should be selected such that its current carrying capacity if sufficient to just meet the requirements of the motor circuit in accordance with standard engineering practices relating to the design of motor supply circuits. The intermediate segment 42, which is disposed within insulating and sealing material 46, has a diameter and cross-sectional area greater than that of segment 40 so that its current carrying capacity is concomitantly greater. It will be appreciated that for most metallic materials, the current carrying capacity is proportional to the cross sectional area. In the particular embodiment illustrated, the inner segment 38 is of the same diameter as intermediate segment 42 and therefore has the same current carrying capacity.

In use, if large, irreversible overcurrent conditions of a catastrophic nature would occur, the temperature of the smaller diameter external segments 40 will increase to the point where they begin to melt, and if this condition persisted for a sufficient length of time, these segments 40 would be completely severed thereby terminating the supply of electric current to terminal 20. Since the intermediate segments 42 and internal segments 38 are of a larger cross sectional area, they would be able to withstand greater amounts of current before they would reach a temperature at which they would begin to melt, and since the melting temperature of the sealing material 46 is higher than that of pins 32, the seal between pins 32 and body member 24 would remain intact. This would prevent terminal blow out with the resulting ejection of the hot, pressurized gasses and liquids within housing 16 which would otherwise occur.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a hermetic motor compressor unit having an outer housing with an opening therein, a hermetically sealed terminal adapted for carrying electric current into said housing comprising: a body member closing the housing opening, said body member having at least one opening therein communicating from the exterior to the interior of the housing; a metallic conductor pin disposed in said body member opening and passing through said body member, said conductor pin comprising a first segment disposed at least partially in said housing and having a first transverse cross-sectional area and a second segment disposed at least partially outside said housing joined to and integral with said first segment and having a second transverse cross-sectional area smaller than the first cross-sectional area, the transverse cross-sectional area of said second segment being such that the current carrying capacity thereof is capable of meeting the requirements of the compressor motor but will melt under irreversible overcurrent conditions and the transverse cross-sectional area of the first segment being such that the current carrying capacity thereof is sufficiently great that it will not melt under irreversible overcurrent conditions, said first and second segments forming a shoulder at the point where they are joined wherein the shoulder faces in a direction externally of the housing; and a continuous block of electrical insulating and sealing material encasing a portion of said first segment, a portion of said second segment and said shoulder and forming a hermetic seal between the encased portions of the pin and said body member, only a small portion of the pin second segment beyond said shoulder being encased by said block of insulating material relative to the portion of the first segment encased thereby, whereby the probability of burning through of said second segment within said block of insulating material is diminished; the electrical insulating and sealing material having a higher melting temperature than the conductor pin first segment.

2. The compressor of claim 1 wherein said conductor pin is made of stainless steel.

3. The compressor of claim 1 wherein said conductor pin is made of copper.

4. The compressor of claim 1 wherein said insulating and sealing material is epoxy.

5. The compressor of claim 1 wherein said insulating and sealing material is glass having an epoxy coating.

6. The motor compressor unit of claim 1 wherein said shoulder is tapered.

7. The compressor of claim 1 including: a plurality of openings in said body member, a plurality of said conductor pins received in respective said openings, said insulating and sealing material forming a hermetic seal between said conductor pins and said body member.

8. The compressor of claim 7 wherein said body member is metallic.

9. In a hermetic motor compressor unit having an outer housing with an opening therein leading to the interior of said housing, a hermetically sealed terminal adapted for carrying electric current into said housing comprising: at least one metallic conductor pin passing into said housing through said opening, said conductor pin comprising a first segment disposed at least partially in said housing and having a first transverse cross-sectional area and a second segment disposed at least partially outside said housing joined to and integral with said first segment and having a second transverse cross-sectional area smaller than the first cross-sectional area, the transverse cross-sectional area of said second segment being such that the current carrying capacity thereof is capable of meeting the requirements of the compressor motor but will melt under irreversible overcurrent conditions and the transverse cross-sectional area of the first segment being such that the current carrying capacity thereof is sufficiently great that it will not melt under irreversible overcurrent conditions, said first and second segments forming a shoulder at the point where they are joined wherein the shoulder faces externally of the housing, a continuous block of electrical insulating and sealing material encasing a portion of said first segment, a portion of said second segment and said shoulder and forming a hermetic seal between the encased portions of the pin and said opening, only a small portion of the pin second segment beyond said shoulder being encased by said block of insulating material relative to the portion of the first segment encased thereby, whereby the probability of burning through of said second segment within said block of insulating material is diminished, the electrical insulating and sealing material having a higher melting temperature than the conductor pin first segment.

10. The compressor of claim 9 wherein said shoulder is tapered.

* * * * *